United States Patent [19]

Koch

[11] Patent Number: 4,642,946

[45] Date of Patent: Feb. 17, 1987

[54] MODULAR DISPLAY SYSTEM

[75] Inventor: Charles P. Koch, Wyoming, Ohio

[73] Assignee: Adex, Inc., Cincinnati, Ohio

[21] Appl. No.: 783,110

[22] Filed: Oct. 2, 1985

[51] Int. Cl.[4] ..... E04B 5/58

[52] U.S. Cl. ..... 52/38; 52/126.6; 52/584; 40/611; 40/605; 40/606

[58] Field of Search ..... 52/126.6, 585, 38, 587, 52/584, 582; 404/34, 35, 40, 41, 39, 46; 40/607, 611 X, 605 X, 606 X, 610

[56] References Cited

U.S. PATENT DOCUMENTS

| | | | |
|---|---|---|---|
| 776,419 | 11/1904 | Platt . | |
| 2,025,815 | 12/1935 | Horridge | 404/41 |
| 2,026,224 | 12/1935 | Drehmann | 404/34 |
| 2,186,561 | 6/1965 | Strassle . | |
| 2,725,271 | 11/1955 | Barnett et al. . | |
| 2,867,301 | 1/1959 | Benton . | |
| 2,970,396 | 2/1961 | Worrell | 40/605 |
| 3,462,110 | 8/1969 | Cheslock . | |
| 3,520,663 | 7/1970 | Schertel . | |
| 3,564,743 | 2/1971 | Gilmoure | 40/607 |
| 3,612,585 | 10/1971 | Mayr . | |
| 4,085,557 | 4/1978 | Tharp | 52/126.6 |
| 4,275,520 | 6/1981 | Appleton et al. . | |
| 4,296,574 | 10/1981 | Stephens | 52/126.6 |
| 4,458,455 | 7/1984 | Tollstoff de Voss . | |
| 4,468,910 | 9/1984 | Morrison | 404/41 |
| 4,470,235 | 9/1984 | Jenni . | |

FOREIGN PATENT DOCUMENTS

| | | | |
|---|---|---|---|
| 683129 | 3/1964 | Canada | 52/584 |
| 1134770 | 4/1957 | France | 404/40 |
| 242895 | 11/1925 | United Kingdom | 52/584 |
| 385017 | 12/1932 | United Kingdom | 404/40 |

*Primary Examiner*—Henry E. Raduazo

*Attorney, Agent, or Firm*—Wood, Herron & Evans

[57] ABSTRACT

A modular display system is provided having a series of floor platforms which are secured together in edge-to-edge contact, by "plug-in" locks at the corners of two or more platforms. The locks engage floor frames below floor panels, through notches or cutout areas at the corners of the panels. Each lock engages at least two frames at their adjoining corners by downwardly projecting prongs, which preferably seat in the interior corner angles of the frames. The lock fits in the contiguous panel cutouts so that it is flush with the surface of the panels. Vertical columns may upstand from the locks, to support light boxes, shelving, tables, and the like.

17 Claims, 2 Drawing Figures

MODULAR DISPLAY SYSTEM

FIELD OF THE INVENTION

This invention relates to modular display systems such as are used for temporary exhibitions at trade shows and the like.

BACKGROUND

It is frequently desirable for manufacturing and service businesses to set up temporary displays to show their products and services at conventions, trade shows and the like. The displays vary greatly from company to company, and even from show to show for the same company; a display may comprise a modest small booth, or may extend elaborately over hundreds of square feet. Typically a display involves one or more tables or shelves on which information or samples are presented, together with vertical graphics, for example, light boxes which mount logos, photographs, or illustrations of the product, or giving company information. Often these displays are quite elaborate, having raised platform floors, carpeting, coordinated architectural fixtures, and special lighting and electrical effects.

Such displays usually must be set up quickly, as in a convention hall, and must also be quickly removed at the end of the show. For an elaborate display, substantial cost is involved in preparing, mounting, and disassembling it.

Modular display equipment is known, but has been quite expensive and required rather cumbersome and slow means to interconnect the modules to form floors or platforms and to erect light columns and display surfaces above the platforms.

There has, therefore, been a need for a simpler, easily erectable modular display system which can be arranged in different configurations to provide floor platforms of different shapes and sizes, and which will accommodate different shapes, positions and types of columns and display surfaces, as different display needs arise.

BRIEF SUMMARY OF THE INVENTION

This invention provides a display system having a platform floor comprising of a series of standard modules in the form of geometrically regular platform units, preferably straight sided and rectangular in plan, which can easily be connected together to provide platforms of different configurations, and which can mount vertical columns or poles which can in turn support shelving, light panels, or other display areas.

In accordance with this invention, the platforms are arrayed in edge-to-edge juxtaposition with other platforms. Each platform comprises an underlying perimetral frame and an overlying floor panel which is coextensive with the frame except at the corners where the vertical sides of the frame meet one another. Each panel has "notched" or cut off corners above the corners of the frame below it. The frame corners are not covered by the panel at its corner notches; and these notches receive locks which lock the frame corners together. The locking means can lock together the adjacent corners of two, three or four adjacent frames, and comprises a plug which fits into the open area defined between the adjacent corner notches of the panels. Each plug has downwardly depending prongs which engage the frames, preferably on the inside faces of the frame at the corners, which prevent the frames from being moved apart from one another. The plugs fills the open area defined by the adjoining corner notches of the panels, so that the panels and plugs provide a smooth, flush decking or floor. Vertical columns may be provided on some or all of the plugs to support display surface means, and for lighting connections. Display surfaces can be connected between vertical columns of the same or different platforms, on which exhibits can be positioned for viewing.

DESCRIPTION OF THE DRAWINGS

The invention can best be described by reference to the accompanying drawings, in which.

DETAILED DESCRIPTION OF PREFERRED EMBODIMENT

Figure 1:
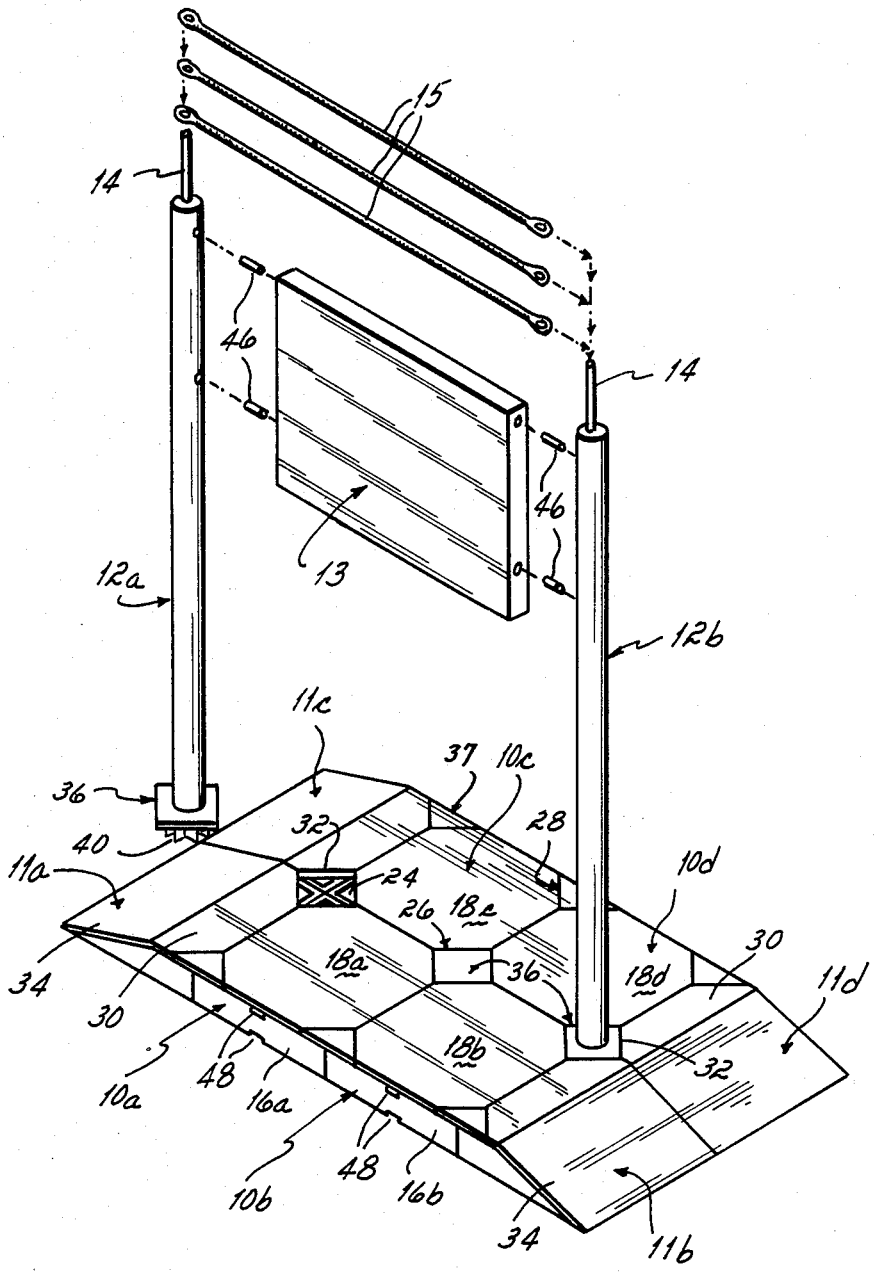
FIG. 1 is an exploded isometric view of a small platform in accordance with a preferred form of the invention, showing the manner in which locking plugs join adjacent frames together, and having vertical columns and display means connected between them.

The display system shown in the drawings comprises four modular floor platform units designated 10*a, b, c,* and *d,* connected together as a 2×2 array. On two lateral edges of the platform, four ramp units 11*a, b, c* and *d* are connected to the platform units to provide a gradually sloping border for the platform. The ramps are optional; it will be appreciated that they may be used on some, all or no sides of the platform, depending upon the particular application. It will further be appreciated that the four platform assembly shown is smaller than would ordinarily be used; however, the principles of the invention remain the same, whatever the size or shape of the particular installation.

The system shown includes two vertical columns, 12*a* and *b,* each of which is mounted at its lower end to a locking means which interconnects the adjacent corners of two ramps and two frames, as will be described in greater detail. The columns, which are optional, may support a display surface 13, which may be a flat panel as shown, or which can alternatively comprise a shadow box or shelving, not illustrated. To hold the columns together at the top against "racking" or shifting, and also for decorative effect, a series of bungee cords 15 can be stretched between projecting rods 14 at the top of each column 12*a* and *b.*

Figure 2:
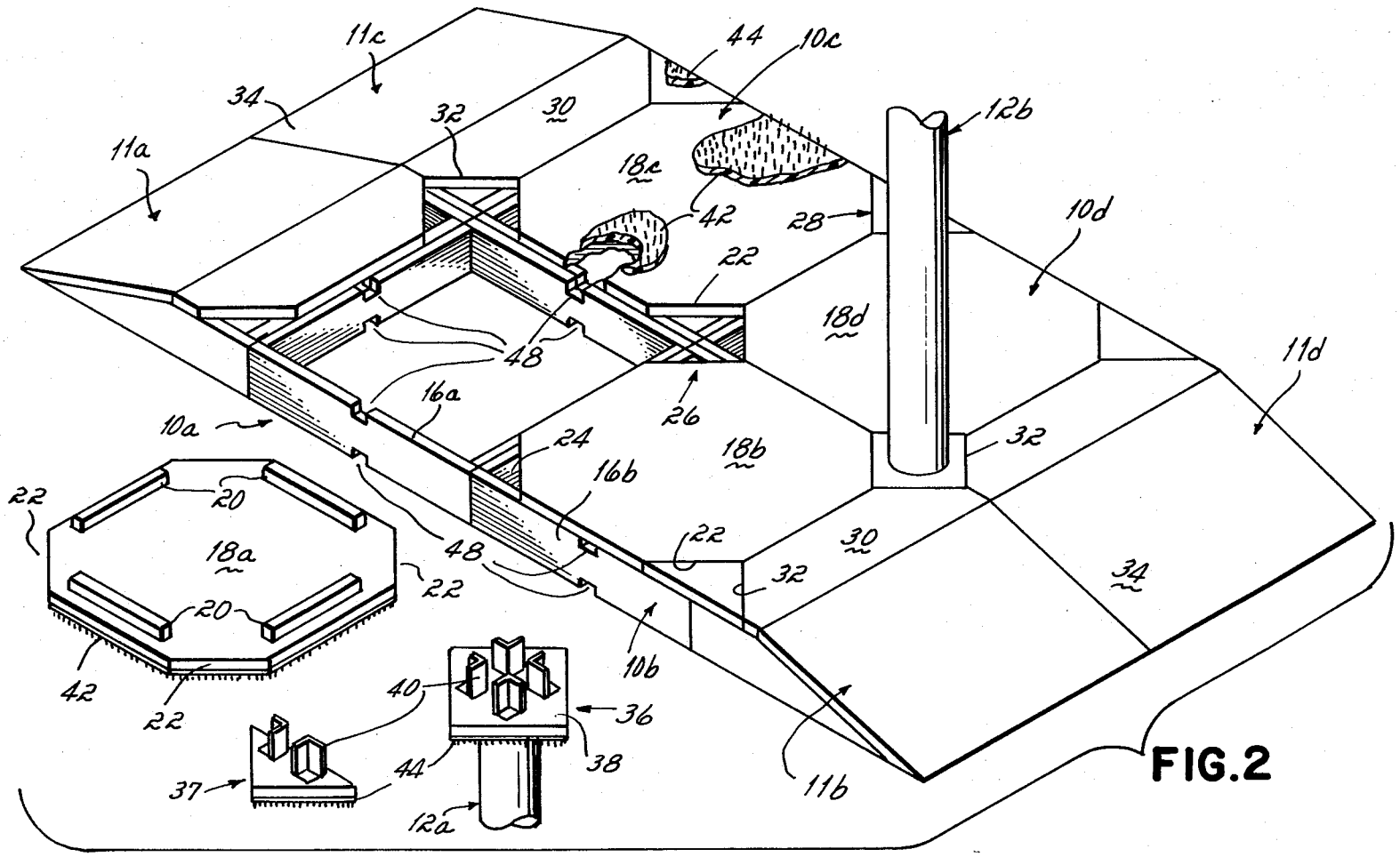
FIG. 2 is an enlarged isometric view similar to FIG. 1 but with one panel, column plug and edge plug removed and inverted to show the means by which they interfit with the frames.

The construction of the individual components of the platform-forming elements of the display system is best seen in FIG. 2. Each platform unit 10 includes a rectangular frame, two of which are designated as 16*a* and *b* in FIG. 2. The frame 16*a* may simply comprise four strips of wood joined at their ends to form a rectangle (a square in the embodiment shown).

Each frame is preferably configured with electric wire openings 48 in its upper and lower edges. These permit wiring to be strung across the frames before the panels are set in place thereon, regardless of which side of the frame is placed down.

Each frame 16 receives a flat surface or panel, designated as 18*a, b, c,* and *d,* respectively. In FIG. 2 the panel 18*a,* which in use would be assembled on Frame 16*a,* is shown inverted to display the aligning cleats 20 on its undersurface. These cleats are positioned so that they will abut the respective inside faces of the frame 16, to keep the panel securely positioned directly over the frame. It will be noted that the exterior dimensions of the panels 18 just match the exterior dimensions of the frames, except at the corners as will be described, so that the vertical edges of the panels 18 are essentially coplanar with the vertical outside faces of the respective frames. In this manner, when the frames are placed together the panels form a flush contiguous surface.

At each of its four corners panel 18 has what may be referred to as a cutoff corner or corner notch, as designated at 22. Most simply, the corners can be mitered at 45° so that when the panel 18 is placed on its respective frame 16 the cutoff edge 22 does not cover the corner of the frame but rather leaves a corner opening, as designated at 24.

As shown in FIG. 2, where four frame corners meet at 26, the notched corners 22 of the respective panels together define an opening 24 above the frames through which the corners of all four frames are accessible. Other than at the corners, the panels are essentially juxtaposed along their edges.

Where the corners of only two frames abut one another, as at 28, the corner notches 22 define a triangular opening over the two frame corners. The corner notches are shaped so that the panels may be variously oriented on the frames but will form uniformly shaped corner openings. Similarly, the edge ramps 11 are provided with horizontal top portions 30 which have two corner notches 32, configured similarly to the corner notches 22 of the panels 18. As seen in FIG. 2, where ramp 11*b* meets frame 16*b*, the adjoining corner notches 22 and 32 define a triangular shape. Outwardly of the flat top surface 30 each ramp 11 has a sloping face 34.

The frames and/or ramps are joined together at the corners by locking means which fit within the open areas 24 defined by the corner notches 22 and/or 32. These locking means include downwardly projecting prong-like means which engage the inside corners of the frames to hold the frames together.

More specifically, a four corner lock is designated generally at 36 in FIG. 2, wherein it is shown in inverted position in FIG. 2. The lock includes a flat plug 38; where the panels are made of plywood, the plug may be plywood of similar thickness, shaped to fit neatly within the open area defined by the corner notches. On the underside of plug 38 are provided projecting (downwardly projecting in use) right angular prongs or brackets, designated at 40 in FIG. 2. These prongs are spaced to define a cruciform area between them and are set apart from one another just sufficiently to straddle the frames. Preferably each prong engages both right angular vertical faces on the inside of the frame at the corner, although this is not absolutely critical. Alternatively the prongs can be received within vertical holes formed in the frames, or the frames can be provided with corner brackets into which the prongs are received. In general, we have found that such corner reinforcements and apertures are not necessary and that it is sufficient (and simpler) for the frames to abut and for the plugs to bear against the inside edges of the frames themselves. Where two rather than four frames meet, a two-frame plug is used, as designated at 37.

To assemble the platform, the frames are first placed in edge-to-edge facial engagement with their corners aligned. The panels are set in place on the frames and the locks are inserted to lock the frames together, and to fill the openings at the corners. It is contemplated that the panels and also the plugs themselves will be carpeted, as designated at 42 and 44 in FIG. 2. With such carpeting, the platform appears to be almost unitary; the discreteness of the panels can thus be visually minimized.

The vertical columns 12 can conveniently be mounted to and above the plugs 38. Each column can be a length of hollow, cylindrical tubing or piping and may have an end plug by which it is secured to screwed to the plug. The column may be configured on its vertical surface to receive decorative veneer, ribbing or cover, and to provide openings into which connections or fasteners 46 can be inserted, to support the display surface. The connection means themselves may be conventional and do not comprise the invention.

As previously described, bungee (elastic) cords 15 can be stretched between rods 14 projecting from the tops of the columns, to tension the columns towards one another and capture the display surface 13 between the connectors 46.

At present it is contemplated that the frames should be wood 1×4s, separate from the panels and that the panels and plugs be ¾ inch plywood. However, it should be understood that the platforms and/or panels could be molded or could be integral with one another, having exposed corner areas to receive the locks by which the units are held together.

While the preferred shape of the corner notches is equilaterally triangular, it will be understood that the corners could also be quarter circular or oval, or indeed of any shape into which a modular plug can be received.

In this system it is thus unnecessary to use bolts or other "through-frame" means to connect the units together; connection is made simply by inserting the locks after the frames have been placed in edgewise engagement with one another. Similarly, the panels are not positively held down but are seated only by gravity and are confined against lateral movement by the cleats which engage the inside of the frames. It is a major advantage of this system that it enables an entire display to be erected on site, and removed, very quickly; moreover, the platform can be assembled in different sizes and shapes, and columns can be installed as desired. The whole system can easily be broken down and stored when not in use.

Having described the invention, what is claimed is:

1. A modular display platform system comprising, (a) a series of modular platforms arrayed side-by-side on a floor, in edgewise contact with one another, each platform comprising, (1) an open centered rectangular peripheral frame having square corners, and (2) a planar rectangular panel separate from but supported by the frame, the panel seated on the edges of the frame so that the panels of said series form an uninterrupted surface, the panel having a triangular corner notch at at least two of its corners, the triangular notches exposing the respective square corners of the frame below; and (b) frame corner connecting means for securing adjacent frames together at their corners, comprising a rectangular plug which fits into the open area defined by the adjacent corner notches on the respective panels, the plug having downwardly depending prongs which engage within the open centers of the frames at the adjacent square corners of the frames, to hold the frames together.

2. The modular display platform system of claim 1 wherein the plug comprises a flat insert of the same thickness as said panel and entirely occupies the open area above the frames which is defined within the adjacent corner notches of the panels.

3. The modular display platform system of claim 2 wherein the downwardly depending prongs of the plug comprise right angle brackets, positioned to engage the inside edges of the corners of the respective adjacent frames.

4. The modular display platform system of claim 3, wherein the frames and panels are rectangular, and the plug has four right angle brackets arranged in cruciform shape, spaced from each other by the thickness of the frames and holding the frames together from opposite inside edge thereof.

5. The system of claim 1 wherein said frame and panel are square and have the same length and width, and said plug is square and is sized to seat within a square open area defined by the adjacent corner notches of the panels.

6. The modular display platform system of claim 1 wherein the corner notches of the panel are isosceles triangular areas.

7. The modular display platform system of claim 1 wherein said frame is comprised of four flat strips, joined at their ends to form a rectangle.

8. The modular display platform system of claim 1 wherein said panel has the same outside dimension as said frame.

9. The modular display platform system of claim 1 wherein said panel has frame aligning cleats secured to its lower face, which fit within the frame so that the panel cannot move laterally relative to the frame.

10. The modular display platform system of claim 1 wherein said panel is covered with carpeting.

11. The modular display platform system of claim 1 wherein the frame has a cut-out in at least two horizontal peripheral edges thereof, through which electrical wires can be strung when the panel is not on the frame.

12. The modular display platform system of claim 1 further having downwardly sloping ramps around the outside of at least part of the platforms of said series, each ramp having a panel sloping gradually downwardly from the panel on the adjacent frame, the panel of the ramp being supported on a frame member having at least one edge which facially engages a frame of said series, ramp corner connecting means for connecting at least two corners of the frame of the ramp to two corners of an adjacent frame of said series, said ramp corner connecting means being similar to the frame corner connecting means.

13. The system of claim 1 wherein said frame comprises a rectangle defined by four side walls, said frame being open at the top and bottom thereof.

14. A modular display platform system comprising, (a) a series of modular platforms arrayed side-by-side on a floor, in edgewise contact with one another, each platform comprising,
  (1) a peripheral frame, and
  (2) a flat panel supported by the frame, the panel covering the edges of the frame so that the panels of said series form an uninterrupted surface, the panel having a corner notch at at least two of its corners, the notches exposing the respective corners of the frame below;

(b) frame corner connecting means for securing adjacent frames together at their corners, comprising a plug which fits into the open area defined by the adjacent corner notches of the respective panels, the plug having downwardly depending prongs which engage within the adjacent corners of the frames to hold the frames together, and a vertical column projecting upwardly from the plug, for supporting a display above the platform.

15. The modular display platform system of claim 14 further including display surface means which is connected between two such columns, on which display items can be positioned for viewing.

16. The modular display system of claim 15 further including elastic tension means stretched between two such columns, to pull the same toward each other and thereby hold said display surface means between them.

17. A modular display system comprising:

(a) a series of modular platforms arrayed edge-to-edge on a floor, each platform comprising,
  (1) a frame having angular corners, and
  (2) a floor panel coextensive with and supported by the frame, the panels of the series forming a contiguous flat surface, each panel having cut-out corners which do not cover the corners of the frame;

(b) corner connecting means for securing the corners of adjacent frames together, comprising a plug which fits into the open area defined by the adjacent cut-out corners of the panels, the plug having downwardly depending prongs which engage the adjoining corners of the frames to hold the frames together, (c) vertical columns mounted by and projecting upwardly from at least two of such plugs, and (d) display surface means interconnected between said columns, or which display items can be positioned for viewing.

* * * * *